US008950033B1

(12) United States Patent
Keeler

(10) Patent No.: US 8,950,033 B1
(45) Date of Patent: Feb. 10, 2015

(54) SPATULA CLEANING DEVICE

(71) Applicant: Timothy M. Keeler, Kalispell, MT (US)

(72) Inventor: Timothy M. Keeler, Kalispell, MT (US)

( * ) Notice: Subject to any disclaimer, the term of this patent is extended or adjusted under 35 U.S.C. 154(b) by 0 days.

(21) Appl. No.: 14/016,768

(22) Filed: Sep. 3, 2013

(51) Int. Cl.
*A47L 17/00* (2006.01)

(52) U.S. Cl.
CPC ..... *A47L 17/00* (2013.01)
USPC ..... 15/236.09; 15/236.01; 15/236.06

(58) Field of Classification Search
USPC ..... 15/236.01, 236.05, 236.06, 236.08, 15/236.09
See application file for complete search history.

(56) References Cited

U.S. PATENT DOCUMENTS

| | | | | |
|---|---|---|---|---|
| 2,707,299 | A * | 5/1955 | Steindorf et al. | 15/236.09 |
| 2,719,313 | A | 10/1955 | Smith | |
| 2,839,772 | A | 6/1958 | Lambert | |
| 2,941,224 | A | 6/1960 | Hercer | |
| 3,372,419 | A | 3/1968 | Howey | |
| 3,396,421 | A * | 8/1968 | Rade | 15/236.09 |
| 4,325,158 | A | 4/1982 | Divish et al. | |
| D296,021 | S | 5/1988 | Conklin | |
| 2010/0236075 | A1 | 9/2010 | Lambert | |
| 2011/0033818 | A1* | 2/2011 | Miller | 433/31 |

* cited by examiner

*Primary Examiner* — Mark Spisich
(74) *Attorney, Agent, or Firm* — Robert C Montgomery; Montgomery Patent & Design

(57) ABSTRACT

A spatula cleaning device for cleaning a spatula by scraping is described. The spatula cleaning device includes a stainless steel base assembly having a base plate, an attachment feature, and a stainless steel blade assembly with a first blade that is attached to a first post affixed to the base plate and a second blade attached to a second post that is affixed to the base plate. The first blade and the second blade are disposed slightly above the base plate and converge toward each other. The first blade and the second blade provide cleaning surfaces for wiping the top and bottom of a spatula on. The attachment feature is either a magnet or a suction cup.

18 Claims, 4 Drawing Sheets

SPATULA CLEANING DEVICE

RELATED APPLICATIONS

There are no current related applications.

FIELD OF THE INVENTION

The presently disclosed subject matter is directed to kitchen utensils. More particularly, the present invention relates to spatula cleaning devices.

BACKGROUND OF THE INVENTION

One (1) of the most common tasks performed is food preparation. Whether food is prepared at home, in a restaurant, or in an institution, food must be prepared several times a day. Food preparation consumes large amounts of time, effort, and money. Whether preparing food is a job, an unavoidable task, or something that one enjoys, food must be prepared.

Not only must food be prepared but the "mess" that results from food preparation must be cleaned up. Health departments demand it and common sense requires it.

There are many different ways to prepare food. However, one (1) very common method, particularly in restaurants, is to grill. Food such as a hamburger is placed on a hot grill, cooked for a while, and then flipped over to cook on the other side. Fast, efficient, and low cost grilling has proven itself to be useful.

While grilling is useful it is not without its problems. One (1) problem in particular is that grilling requires flipping, which in turn requires a spatula. As used herein a spatula refers to any food preparation tool having a handle and a blade wherein the blade is placed under a food item on a heated cooking surface to raise the food item from that heated cooking surface for the purpose of turning the food item onto the other side or to remove the food item from the heated cooking surface. Spatulas are also known as turners.

Spatulas work well, but they also have their problems. One (1) problem in particular is that the same spatula can be used to flip and/or remove any number of different food items from a heated cooking surface. A spatula picks up a hamburger, flips that burger, and then may be used to flip a chicken breast, egg, or pancake. Some of the hamburger may stick to the spatula and be transferred to the other items. Even worse, the grease from the first food item might end up on the second and consecutive items. Food and flavor contamination would ensue. However, cleaning the spatula with soap and water is not practical, particularly when many different items are being prepared.

In view of the foregoing, a simple to use, fast acting spatula cleaner would be useful. Such a device that is easy to clean and that can be moved from one location to another would be particularly useful.

SUMMARY OF THE INVENTION

The principles of the present invention provide for a spatula cleaning device for cleaning spatulas.

A spatula cleaning device that is in accord with the present invention includes a base assembly having a base plate with a first aperture and a second aperture. At least one (1) magnet is attached to the base plate. The spatula cleaning device also includes a blade assembly having a first blade that is attached to a first post which is affixed to the base plate and a second blade that is attached to a second post that is also affixed to the base plate. The first blade and the second blade are disposed slightly above said base plate.

In practice, the magnet is attached to the base plate by a threaded magnet fastener that passes through the first aperture. Additionally the magnet has a counter-bored aperture that receives the magnet fastener. Beneficially, the blade assembly is comprised of stainless steel and the first post is a stainless steel hexagonal bar. Preferably the first blade is welded to the first post, and the first post is internally threaded. In practice the first post is affixed to the base plate using a stainless steel threaded post fastener that passes through the second aperture. The first post should be made from a different grade of stainless steel than the threaded post fastener. To assist cleaning of a spatula, the first blade and the second blade should converge towards each other at a blade disposition angle. That blade disposition angle beneficially produces a blade set clearance between the ends of the first blade and the second blade.

An alternative spatula cleaning device that is in accord with the present invention includes a base assembly having a base plate with a first aperture and a second aperture. At least one (1) suction cup is attached to the base plate. The spatula cleaning device also includes a blade assembly having a first blade that is attached to a first post which is affixed to the base plate and a second blade that is attached to a second post that is also affixed to the base plate. The first blade and the second blade are disposed slightly above said base plate.

In practice the suction cup is attached to the base plate by a threaded fastener that passes through the first aperture. Additionally the suction cup is beneficially comprised of a flexible rubber material. In practice, the blade assembly is comprised of stainless steel and the first post is a stainless steel hexagonal bar. Preferably the first blade is welded to the first post, and the first post is internally threaded. In practice the first post is affixed to the base plate using a stainless steel threaded post fastener that passes through the second aperture. The first post should be made from a different grade of stainless steel than the threaded post fastener. To assist cleaning of a spatula, the first blade and the second blade should converge towards each other at a blade disposition angle. That blade disposition angle beneficially produces a blade set clearance between the ends of the first blade and the second blade.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
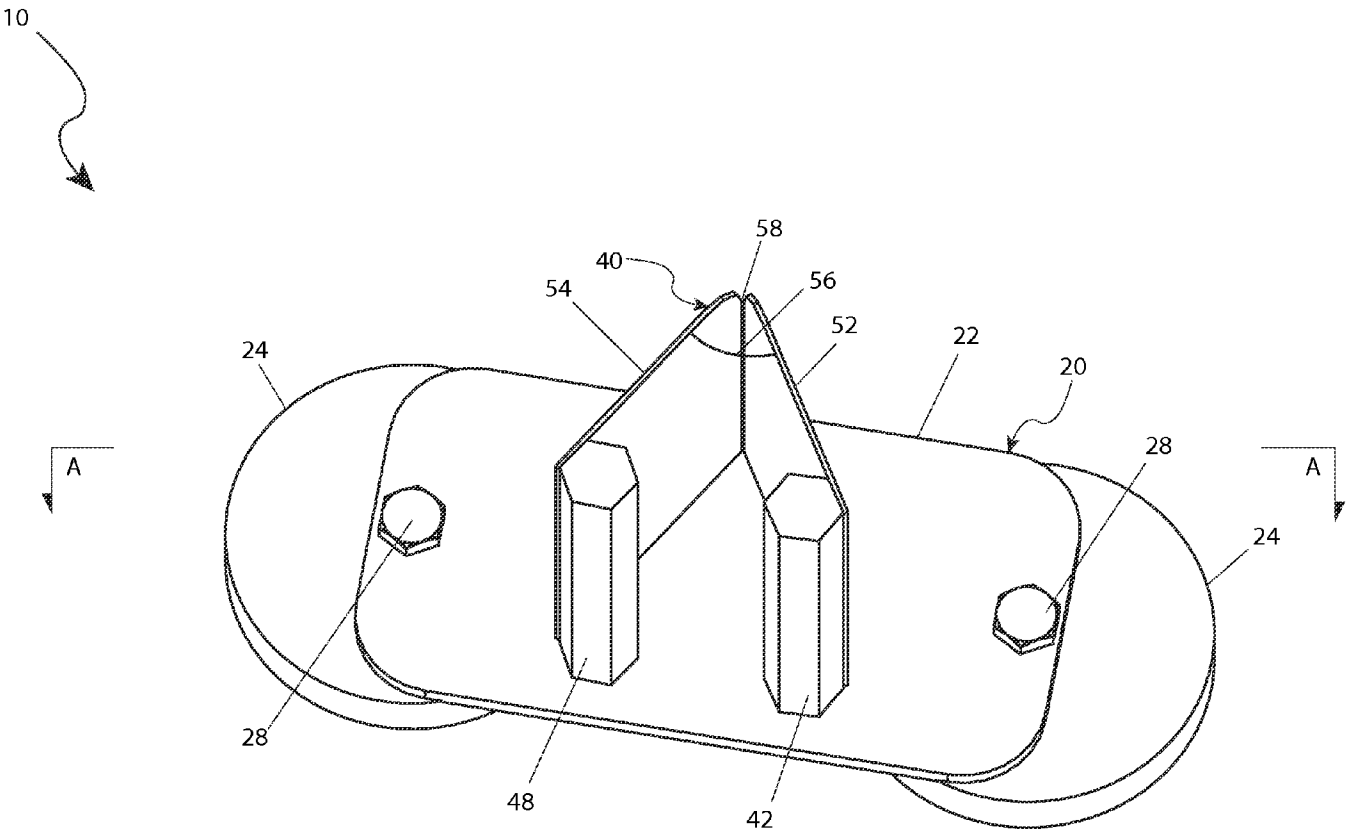
FIG. 1 is a perspective view of a spatula cleaning device 10 that is in accord with the preferred embodiment of the present invention.

10 spatula cleaning device
15 alternate embodiment

20 base assembly
22 base plate
24 magnet
26 aperture
27 counter bore
28 magnet fastener
32 first aperture
34 second aperture
40 blade assembly
42 first post
44 post channel
46 post fastener
48 second post
52 first blade
54 second blade
56 blade disposition angle
58 blade set clearance
61 suction cup post
62 suction cup
100 spatula
101 blade

DETAILED DESCRIPTION OF THE PREFERRED EMBODIMENT

Figure 2:
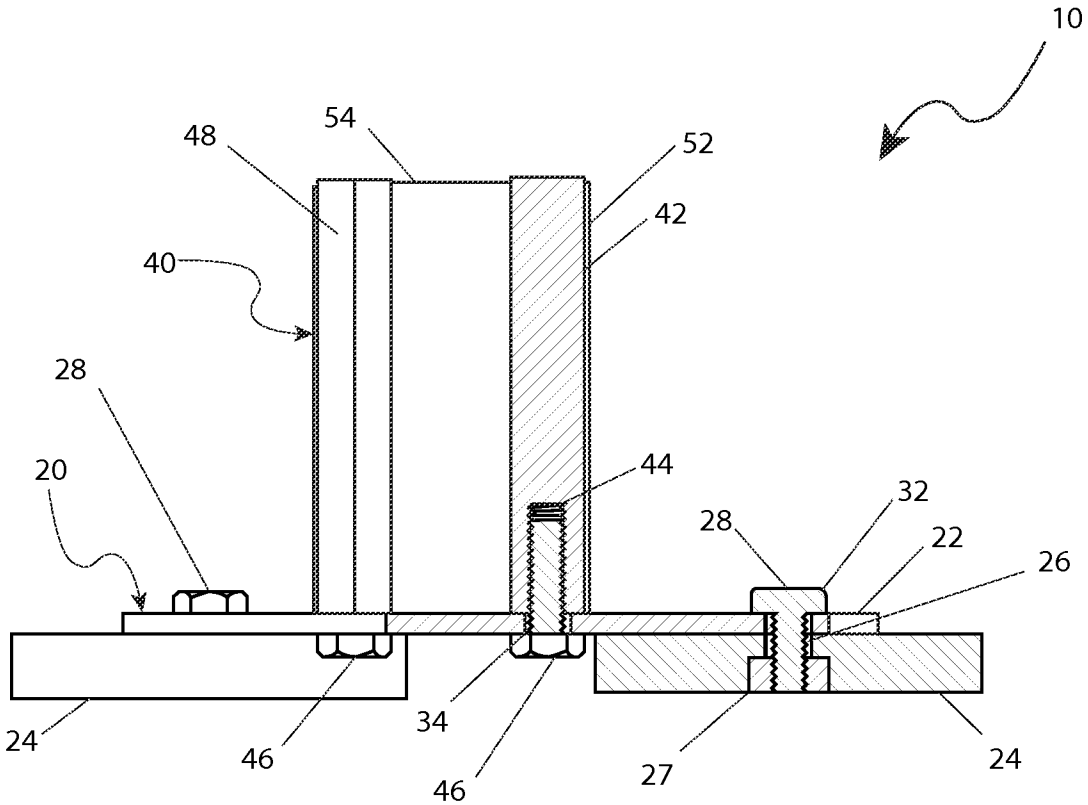
FIG. 2 is a section view along line A-A of FIG. 1 illustrating a first post 42 and a magnet 24.
Figure 3:
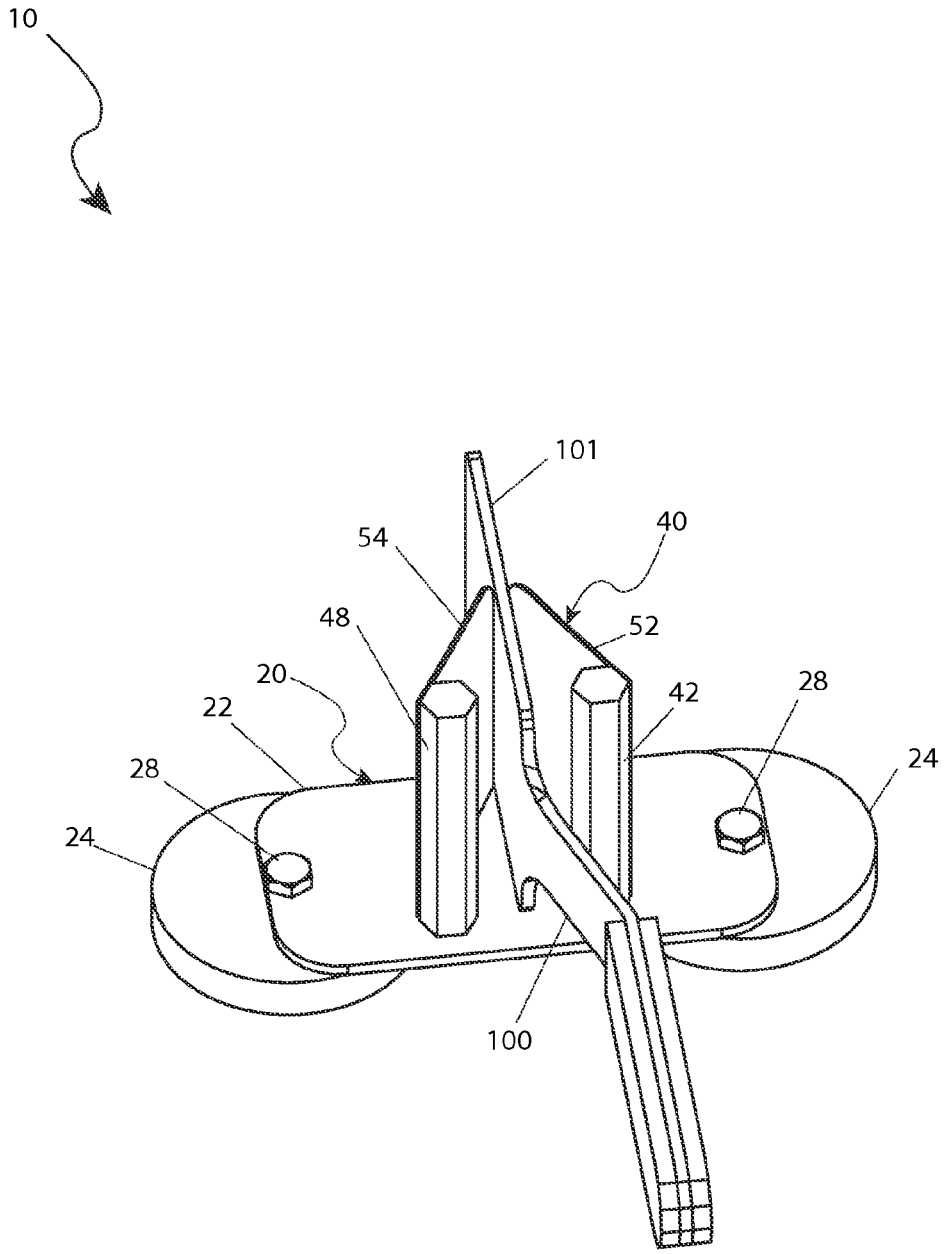
FIG. 3 illustrates the spatula cleaning device 10 of FIG. 1 with a spatula 100 disposed between a first blade 52 and a second blade 54; and, FIG. 4 presents a perspective view of alternate embodiment spatula cleaning device 15.
Figure 4:
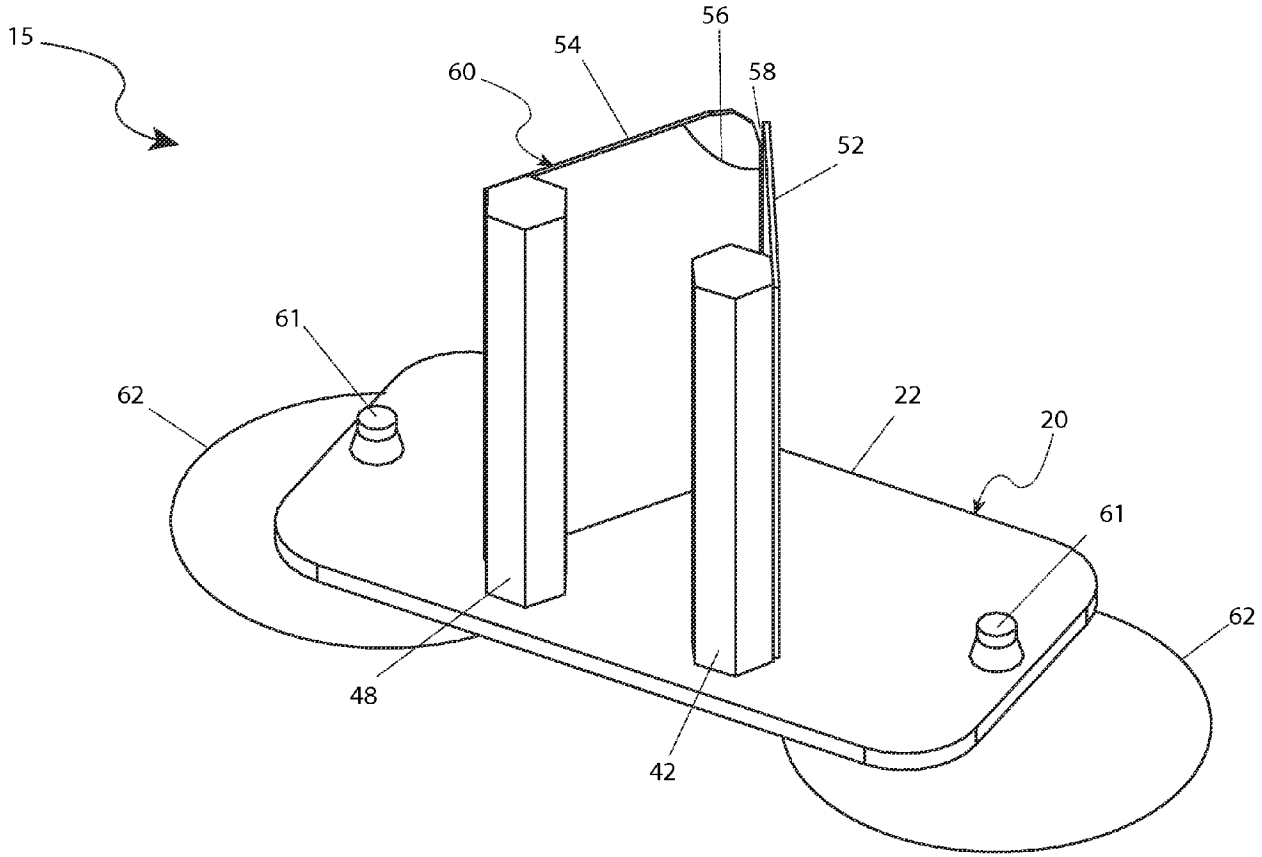

The best mode for carrying out the invention is presented in terms of its preferred embodiment, herein is depicted in FIGS. 1 through 3 and an alternative embodiment is illustrated in FIG. 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 3, the present invention describes a spatula cleaning device 10 that is used for scraping food particles and/or grease from the blade 101 of a spatula 100.

FIG. 1 presents a perspective view of the spatula cleaning device 10 while FIG. 2 presents a section of the spatula cleaning device 10 taken along section line A-A of FIG. 1. As shown, the spatula cleaning device 10 includes a base assembly 20, a blade assembly 40, and a magnet 24. The base assembly 20 has a stainless steel base plate 22 having at least one (1) first aperture 32 and at least two (2) second apertures 34 (only one is shown in the section view, the other is for the fastener 46). The base plate 22 receives the magnet 24 which is attached to the base plate 22 by a threaded magnet fastener 28 that passes through the first aperture 32.

The magnet 24 is a magnetic disk that is approximately two and eleven-sixteenth inches ($2^{11}/_{16}$ in.) in diameter and has a centrally located magnet aperture 26 with a counter bore 27 that provides clearance for the magnet fastener 28. The magnet 24 is used to temporarily attach the spatula cleaning device 10 to a magnetic surface for stability.

The blade assembly 40 is preferably comprised of stainless steel. It includes a first blade 52 that is welded to a first post 42 and a second blade 54 that is welded to a second post 48. The first post 42 and the second post 48 are preferably stainless steel hexagonal bars that are approximately three inches (3 in.) long. The bottoms of the first post 42 and the second post 48 are internally threaded, preferably with a unified national fine thread profile (see FIG. 2). The first post 42 and the second post 48 are affixed to the base plate 22 using threaded post fasteners 46 that pass through the second apertures 34. To prevent thread galling the threaded post fasteners 46 are preferably made from a different grade of stainless steel than the first and second posts 42, 48.

The first blade 52 and the second blade 54 are approximately two inches (2 in.) wide and two and fifteen-sixteenth inches ($2^{15}/_{16}$ in) high. The first blade 52 and the second blade 54 are symmetrically positioned such that a slight gap exists between the first blade 52 and second blade 54 and the base plate 22 (best shown in FIG. 3 where blade 101 contacts the base plate 22 below the first blade 52 and the second blade 54).

The first blade 52 and the second blade 54 converge towards each other at a blade disposition angle 56. That angle, which is shown in FIG. 4, permits a definite blade set clearance 58 between the ends of said blades 52, and 54.

FIG. 4 shows a perspective view of a second embodiment spatula cleaning device 15 that is in according with the principles of the present invention. As noted previously, like numbers in alternative embodiments refer to the same features.

The spatula cleaning device 15 includes a plurality of suction cups 62 that are made from a rubberized or other similarly pliable material. Each suction cup 62 is attached to the base plate 22 by a base plate fastener 61 that passes through first apertures 32 (reference FIG. 2) in the base plate 22. These suction cups 62 temporarily fasten the spatula cleaning device 15 to a smooth, non-porous surface without marring that surface. Except for the use of suction cups 62 instead of magnets 24 the spatula cleaning device 15 is the same as the spatula cleaning device 10.

The preferred embodiment of the present invention can be utilized by the user in a simple and straightforward manner with little or no training. After initial purchase or acquisition of the spatula cleaning device 10, it would be utilized as indicated in FIG. 3. The method of utilizing the spatula cleaning device 10 may be achieved by: acquiring a model of the spatula cleaning device 10; placing the spatula cleaning device 10 on a grill or griddle with the first post 42 and the second post 48 toward the user; placing the spatula 100 into the blade set clearance 58; and scraping the bottom and the top of the blade 101 against opposite blades 52, 54 of the spatula cleaning device 10. A more aggressive scraping action can be obtained by angling the spatula handle relative to the spatula cleaning device 10 to obtain stronger scraping.

The method of utilizing the spatula cleaning device 15 can be achieved by performing the following steps: acquiring a model of the spatula cleaning device 15; placing the spatula cleaning device 15 on a flat, level, non-porous surface with the first post 42 and the second post 48 oriented toward the user; placing the spatula 100 into the blade set clearance 58; and scraping the bottom and the top of the blade 101 against opposite blades 52, 54 of the spatula cleaning device 15.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A spatula cleaning device, comprising:

a base assembly having a base plate with a first aperture and a second aperture;

at least one magnet attached to said base plate; and, a blade assembly having a first blade attached to a first post that is affixed to said base plate and a second blade attached to a second post that is affixed to said base plate;

wherein said first blade and said second blade are disposed slightly above said base plate; and, wherein said magnet is attached to said base plate by a threaded magnet fastener that passes through said first aperture.

2. The spatula cleaning device according to claim 1, wherein said magnet has a counter-bored aperture receiving said magnet fastener.

3. The spatula cleaning device according to claim 1, wherein said blade assembly is comprised of stainless steel.

4. The spatula cleaning device according to claim 3, wherein said first post is a stainless steel hexagonal bar.

5. The spatula cleaning device according to claim 4, wherein said first blade is welded to said first post.

6. The spatula cleaning device according to claim 5, wherein said first post is internally threaded, and wherein said first post is affixed to said base plate by a stainless steel threaded post fastener that passes through said second aperture.

7. The spatula cleaning device according to claim 6, wherein said first post is made from a different grade of stainless steel than said threaded post fastener.

8. The spatula cleaning device according to claim 1, wherein said first blade and said second blade converge towards each other at a blade disposition angle.

9. The spatula cleaning device according to claim 8, wherein said blade disposition angle produces a blade set clearance between ends of said first blade and said second blade.

10. A spatula cleaning device, comprising:

a base assembly having a base plate with a first aperture and a second aperture;

at least one suction cup attached to said base plate; and, a blade assembly having a first blade attached to a first post that is affixed to said base plate and a second blade attached to a second post that is affixed to said base plate;

wherein said first blade and said second blade are disposed slightly above said base plate and, wherein said at least one suction cup is attached to said base plate by a threaded fastener that passes through said first aperture.

11. The spatula cleaning device according to claim 10, wherein said at least one suction cup is comprised of a flexible rubber.

12. The spatula cleaning device according to claim 10, wherein said blade assembly is comprised of stainless steel.

13. The spatula cleaning device according to claim 12, wherein said first post is a stainless steel hexagonal bar.

14. The spatula cleaning device according to claim 13, wherein said first blade is welded to said first post.

15. The spatula cleaning device according to claim 14, wherein said first post is internally threaded, and wherein said first post is affixed to said base plate by a stainless steel threaded post fastener that passes through said second aperture.

16. The spatula cleaning device according to claim 15, wherein said first post is made from a different grade of stainless steel than said threaded post fastener.

17. The spatula cleaning device according to claim 10, wherein said first blade and said second blade converge towards each other at a blade disposition angle.

18. The spatula cleaning device according to claim 17, wherein said blade disposition angle produces a blade set clearance between ends of said first blade and said second blade.

* * * * *